US006931757B2

(12) United States Patent
Greubel et al.

(10) Patent No.: US 6,931,757 B2
(45) Date of Patent: Aug. 23, 2005

(54) METHOD FOR CONDITIONING FIBROUS SUBSTANCES

(75) Inventors: Dieter Greubel, Braunschweig (DE); Timon Gruber, Braunschweig (DE)

(73) Assignee: Fraunhofer-Gesellschaft zur Forderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 10/416,654

(22) PCT Filed: Oct. 6, 2001

(86) PCT No.: PCT/DE01/03842

§ 371 (c)(1),
(2), (4) Date: Oct. 2, 2003

(87) PCT Pub. No.: WO02/40932

PCT Pub. Date: May 23, 2002

(65) Prior Publication Data

US 2004/0060198 A1 Apr. 1, 2004

(30) Foreign Application Priority Data

Nov. 14, 2000 (DE) ..... 100 56 459

(51) Int. Cl.[7] ..... F26B 3/08
(52) U.S. Cl. ..... 34/363; 34/367; 34/378
(58) Field of Search ..... 34/329, 330, 343, 34/359, 363, 367, 376, 377, 378; 110/227, 257

(56) References Cited

U.S. PATENT DOCUMENTS 5,271,162 A 12/1993 Kunz et al.
5,328,562 A * 7/1994 Rafferty et al. ..... 162/21
5,637,192 A * 6/1997 Mansour et al. ..... 162/29
5,935,525 A * 8/1999 Lincoln et al. ..... 422/121

FOREIGN PATENT DOCUMENTS

| | | | |
|---|---|---|---|
| DE | 29509816 | U1 | 6/1995 |
| DE | 19654043 | A1 | 12/1996 |
| EP | 0457203 | A1 | 5/1991 |
| EP | 0508546 | A1 | 4/1992 |
| EP | 0714006 | A1 | 5/1996 |
| WO | PCT/AT89/00047 | | 5/1989 |
| WO | PCT/SE92/00214 | | 4/1992 |

* cited by examiner

*Primary Examiner*—Stephen Gravini
(74) *Attorney, Agent, or Firm*—Whitham, Curtis & Christofferson, PC

(57) ABSTRACT

The invention relates to a method for conditioning fibrous substances, especially wood fibers that are dried in a dryer. In a substantially closed drying circuit (1) a vapor-gas mixture is guided in said dryer as a circulating gas (referred to as vapors) that is separated from the dried fibers (6) in a separator (5) once it has passed the drier, and is then returned to a first heat exchanger (7) connected to the drying circuit (1). Gas is heated in a furnace (11) and is supplied to the heat exchanger to heat the vapors. A partial flow (8) of the vapors is coupled out upstream of the first heat exchanger (7) when seen in the direction of the drying circuit (1), heated in a second heat exchanger (10) and is then supplied to the furnace (11) and combusted. In order to reduce emissions and save energy, the partial flow (8) of vapors coupled out, before being heated in the second heat exchanger (10), is cooled in a vapor condenser (9) and depleted, and the resulting condensation product (14) is fed out.

19 Claims, 1 Drawing Sheet

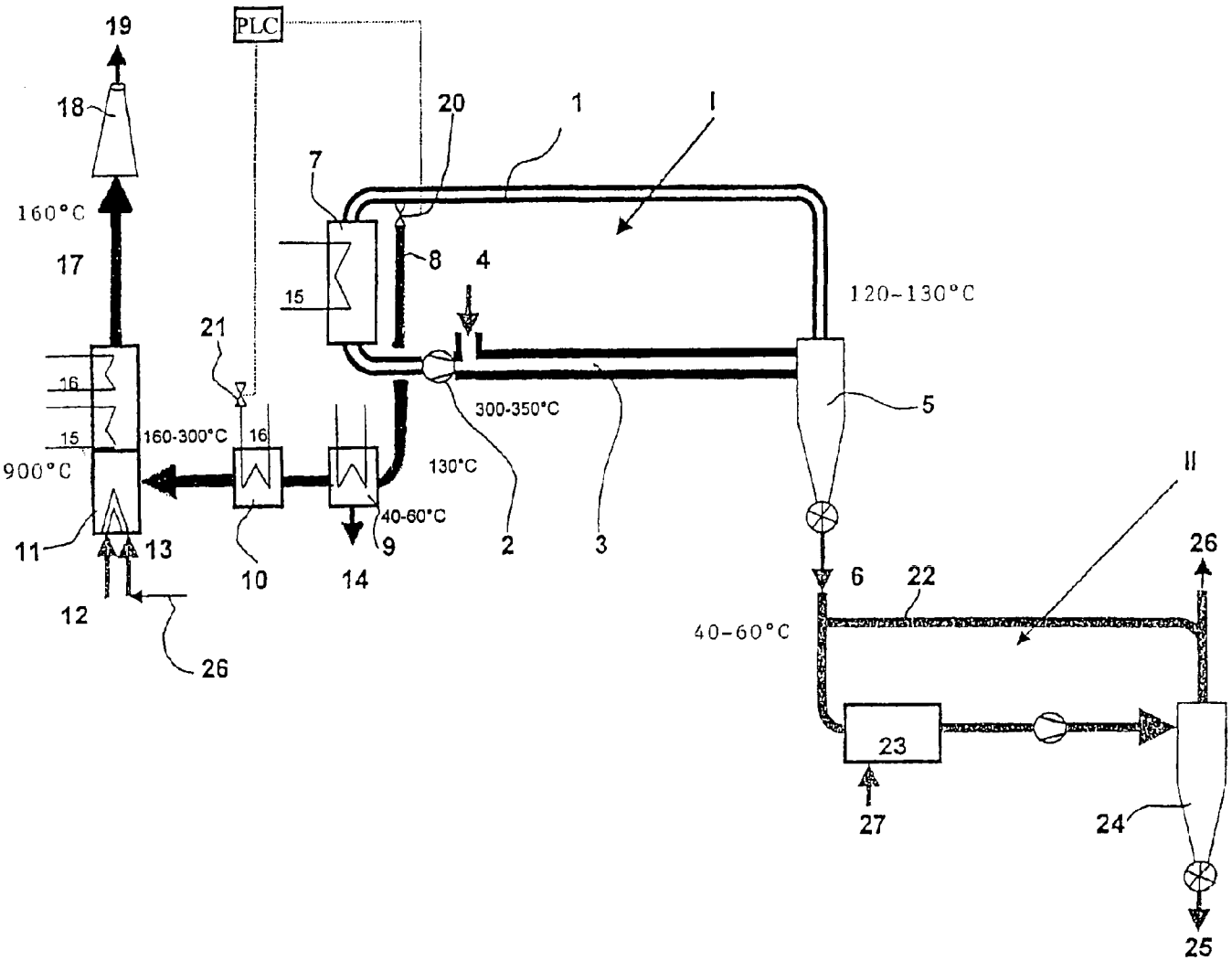
I
II
1
2
3
4
5
6
7
8
9
10
11
12
13
14
15
16
17
18
19
20
21
22
23
24
25
26
27
PLC
120-130°C
40-60°C
300-350°C
130°C
40-60°C
160-300°C
160°C
900°C

METHOD FOR CONDITIONING FIBROUS SUBSTANCES

The invention relates to a method for conditioning fibrous substances, in particular wood fibers, which are dried in a drier through which a vapor/gas mixture is guided, in an essentially closed drying circuit, as circulating gas ("vapors" hereafter) which, after running through the drier, is separated from the dried fibers in a separator and is then returned into a first heat exchanger which is connected into the drying circuit and to which a gas heated via a furnace is supplied for heating the vapors, a part stream of the vapors being uncoupled upstream of this first heat exchanger, as seen in the direction of flow of the drying circuit, being heated in a second heat exchanger and then being introduced into the furnace and burnt there.

A method for the drying of, in particular, wood chips may be gathered from EP 0 714 006 B1. What is provided here is the use of a drum-type drier, through which is guided, in an essentially closed circuit, a vapor/gas mixture which is heated in a first heat exchanger and, after running through the drum-type drier, is returned into the first heat exchanger. In this case, to heat the vapor/gas mixture, an exhaust gas heated in a combustion chamber of a burner is supplied to the first heat exchanger. Part of the vapor/gas mixture, before being introduced into the first heat exchanger, is uncoupled from the circuit, led through a further heat exchanger and introduced into the combustion chamber, in which combustion of the gases occurring during drying takes place. The heated exhaust gas emerging from the combustion chamber, before being supplied into the first heat exchanger, is guided through said further heat exchanger, the uncoupled part of the vapor/gas mixture being heated.

Comparable methods for the drying of, in particular, sewerage sludge, fish meal, sludges from starch, soap and paper factories, biomass products, such as wood chips, grass and sugar beet cossettes, may be gathered from the prior publications DE 295 09 816 U1 or EP 0 457 203 A1. In these methods, too, only drying drums are used. For process monitoring, at various points measuring systems are provided, via which, for example, the quantity of the vapor/air mixture to be uncoupled can be controlled. The uncoupled vapor/air mixture is dried in a condenser and then delivered as secondary air to a combustion chamber, while a drop separator may also normally be provided upstream of the combustion chamber and, if appropriate, a heat exchanger for heating the secondary air may also be provided downstream of said drop separator, the heat exchanger being heated by the combustion gases which emerge from the heat exchanger and are subsequently discharged into the environment via an exhaust-air chimney.

The drum-type drier used in this previously known method does not make it possible to employ fibrous substances with low bulk weight and high internal friction, since, where such substances are concerned, the transport mechanism within the rotary tube does not function. In this previously known method, a high proportion of incidental vapor (as propulsive vapor) leads to an increased fuel consumption.

A thermal drier for bulk materials, such as, for example, wood chips, may be gathered from DE 196 54 043 A1. A rotary drum drier and a specific furnace for generating the necessary drying heat are provided, but without the furnace exhaust gases being supplied directly to the rotary drum drier. At least one gas/gas heat exchanger, which extracts heat from the furnace exhaust gases, is provided. Provided, furthermore, is a vapor circuit which comprises the drying apparatus and a return for vapors emerging from the latter toward the inlet point again, a part stream of the vapors, which is in excess as a result of the drying taking place in the drying apparatus, being drawn off from the vapor circuit and being supplied as secondary air to the furnace where the organic pollutants contained are largely burnt at temperatures of at least 800° C. The gas/gas heat exchanger arrangement transmits the heat extracted from the furnace exhaust gases to the vapors which flow in the vapor circuit to the drier inlet side and which thereafter re-enter the drying apparatus and there, while being cooled, serve as a drying agent. Moreover, an air preheater is provided, which extracts additional heat from the furnace exhaust gases, after these have run through the gas/gas heat exchanger for vapor heating, and transmits said additional heat to fresh air which is supplied to the drier. At least one heat exchanger is additionally arranged, as a heater, upstream of the gas/gas heat exchanger arrangement in the stream of the furnace exhaust gases and has flowing through it on the heating side the furnace exhaust gases, which are at the same time cooled, and thereby either generates on the cooling side vapor or heats a liquid heat transfer medium flowing through on the cooling side and having high volume-specific heat capacity, there being arranged as a heating register in the drying apparatus for the additional heating of the latter, downstream of the vapor-heated drying zone, at least one heat exchanger which, on its heating side, condenses vapor, with heat being discharged at the same time, or cools a liquid heat transfer medium having high volume-specific heat capacity. As a result, on the cooling side, in addition to the heating by vapors which has previously taken place, further heat is supplied to the drying apparatus, the heater and the heating register forming a heating-medium circuit.

The object on which the invention is based is to develop a conditioning method for fibrous substances which is improved particularly in energy terms.

This object is achieved, according to the invention, in that the uncoupled vapor part stream, before being heated in the second heat exchanger, is cooled in a vapor condenser and thereby depleted, and the condensate occurring at the same time is fed out, in that this fed-out condensate is used for the generation of propulsive vapor in a refiner employed for fiber production, and in that the wet fibers produced in the refiner are fed, together with the propulsive vapor, into a tubular stream drier used as a drier.

The condensate trap provided according to the invention reduces the amount of energy used, particularly in the reheating of the residual vapors. In this case, according to the invention, the vapor uncoupling takes place by temperature regulation, with the aim of optimum gas/gas combustion and emission reduction. The emission-related regulation of the temperature of the fed-out vapors affords the possibility of minimizing the emission at any operating point.

To lower the temperature level in the conditioning process, it is expedient if the first heat exchanger is acted upon by hot gas heated by the combustion exhaust gas of the furnace and guided in a first closed circuit, and, furthermore, if the second heat exchanger is acted upon by the hot gas heated by the combustion exhaust gas of the furnace and guided in a second closed circuit.

Substantial advantages arise due to the use of a tubular stream drier, in which the wet fibers are fed into the vapors flowing through it.

By means of the tubular stream drier, a short dwell time of the fibers of the order of magnitude of 2–10 seconds can be achieved. As a result, the fiber material in the tubular stream drier is dried in the fluidized state and cannot "cake together". The process temperatures in the tubular stream drier are always above the water boiling point at between 100° C. and 350° C. Drying by hot vapor reduces the risk of over-drying, since the fibers are moistened at the outset. Heat transmission is thereby increased as compared with conventional drying; this results in a shorter drying time. Consequently, according to the invention, in addition to the wet fibers, propulsive vapor is fed into the tubular stream drier, with the result that a considerably higher temperature level, as compared with conventional methods, can be implemented in the drier.

By the use, provided according to the invention, of the condensate fed out of the vapor condenser for the generation of propulsive vapor in a refiner used for fiber production, the water demand necessary for fiber conditioning can be reduced considerably.

There is, in principle, also the possibility of using part of the condensate fed out of the vapor condenser as mixing water for fiber glue-coating.

For fiber conditioning, it is expedient if the dried fibers separated out of the drying circuit are glue-coated in a following glue-coating station. In this case, it is advantageous if the dried fibers are fed into a largely closed glue-coating air circuit, run through a glue-wetting zone and, in a separator, following the latter, are separated from the transport air carried in the circuit.

By the residual heat being utilized in the following glue-coating stage, the energy consumption is further reduced.

Further features of the invention are the subject matter of the subclaims and are explained in more detail, in conjunction with further advantages of the invention, with reference to an exemplary embodiment.

The drawing illustrates a plant, serving as an example, for carrying out an example of the method according to the invention. This is a plant for the low-emission drying of wood fibers in circulating gas, with following glue-coating.

The plant part relating to drying is designated by I and the plant part relating to glue-coating by II.

The drying I comprises an essentially closed drying circuit 1, through which a vapor/gas mixture acted upon by a fan 2 circulates as circulating gas which is designated hereafter as vapors. One portion of this drying circuit 1 is designed as a tubular stream drier 3, into which wet fibers 4 and propulsive vapor are fed in an order of magnitude of about 30–50% of the mass flow. After running through the tubular stream drier 3, the fibers are separated from the vapors in a separator 5, which follows said tubular stream drier and is preferably a cyclone separator, and are discharged as dry fibers 6. The vapors are returned into a first heat exchanger 7 connected into the drying circuit 1 and are led through said heat exchanger, in order subsequently to flow anew through the tubular stream drier 3.

A part stream 8 of the vapors is uncoupled upstream of the first heat exchanger 7, as seen in the direction of flow of the drying circuit 1, is cooled in a vapor condenser 9 and thereby depleted, is reheated in a following second heat exchanger 10 and is then introduced into a furnace 11 and burnt there. The combustion chamber of the furnace 11 has a connection for the in-feed of gas 12 and a connection for the in-feed of combustion air 13.

The condensate 14 occurring in the vapor condenser 9 is fed out of the condenser and used, for example, for the generation of propulsive vapor in a refiner used for fiber production and/or as mixing water for fiber glue-coating.

The combustion exhaust gases generated in the furnace 11 act, together with the thermally repurified vapor part stream, upon a first hot-gas circuit 15 which is guided through the first heat exchanger 7. Furthermore, a second hot-gas circuit 16 which is guided through the second heat exchanger 10 is acted upon. Subsequently, the exhaust gas 17 cooled as a result of action upon the two hot-gas circuits 15, 16 is led as exhaust air 19 out of a chimney 18 into the atmosphere.

Vapor uncoupling takes place by temperature regulation. For this purpose, the vapor uncoupling and the reheating of the depleted vapor part stream are controlled by a freely programmable control programmable logic controller (PLC), for the vapor part stream 8 to be uncoupled and by an activated regulating valve 21 in the inflow of the second heat exchanger 10.

In the exemplary embodiment illustrated, the following method temperatures are noted: a temperature 300–350° C. will be set at the inlet of the tubular stream drier 3 and a temperature of about 120–130° C. will be set at the drier outlet. The vapors carried in the circuit are therefore heated from said low temperature to 300–350° C. in the first heat exchanger 7. The vapor part stream 8 uncoupled upstream of the first heat exchanger 7 thus has a temperature of 120–130° C., is cooled in the vapor condenser 9 to about 40–60° C. and is subsequently heated again to a temperature of about 160–300° C. in the second heat exchanger 10. The combustion exhaust gases of the furnace 11 reach a temperature of approximately 900° C. and, after the two hot-gas circuits 15, 16 have been acted upon, are then cooled to approximately 160° C.

The dwell time of the fibers in the tubular stream drier 3 is about 2–10 seconds. In this time, the fibers are dried to 2–4% atro.

The dry fibers 6 separated out in the separator 5 are fed into a largely closed glue-coating air circuit 22, run through a glue-wetting zone 23, in which glue 27 is injected, and, in a separator 24 following the latter, are separated from the transport air carried in the circuit. The glue-coated fibers 25 emerging from the separator 24, which is preferably a cyclone separator; are supplied for further processing.

The transport speed of the fibers passing through the glue-wetting zone 23 is between 20 and 35 m/s, preferably about 27 m/s. The temperature of the transport air is about 40–60° C.

Infiltrated air 26 is extracted from the glue-coating air circuit 22 via an air exit lock and is fed as additional combustion air into the combustion chamber of the furnace 11.

What is claimed is:

1. A method for conditioning a fibrous substance, comprising the steps of circulating a stream of vapor in an essentially closed drying circuit, wherein the essentially closed drying circuit comprises a tubular stream drier, and wherein the stream of vapor flows through the tubular stream drier;

feeding wet fibers and propulsive vapor into the tubular stream drier in order to dry the wet fibers, separating dried fibers from the stream of vapor;

returning the stream of vapor to a first heat exchanger;

uncoupling a part of the stream of vapor upstream of the first heat exchanger;

cooling the uncoupled part of the stream of vapor in a vapor condenser, wherein condensate from the vapor condenser is used to generate propulsive vapor in a refiner, and wherein wet fibers produced in the refiner and the propulsive vapor generated in the refiner are fed into the drier in the feeding step;

reheating the uncoupled part of the stream of vapor in a second heat exchanger;

introducing the reheated uncoupled part of the stream of vapor into a furnace; and burning the reheated uncoupled part of the stream of vapor in the furnace.

2. The method as claimed in claim 1, wherein the step of uncoupling takes place in a temperature-controlled manner.

3. The method as claimed in claim 1, wherein the uncoupled part of the stream of vapor is cooled in the vapor condenser to a temperature of 40–60° C., and the uncoupled part of the stream of vapor thus depleted is heated to a temperature of 160–300° C. in the following second heat exchanger.

4. The method as claimed in claim 1, wherein the first heat exchanger is acted upon by hot gas heated by the combustion exhaust gas of the furnace and guided in a first closed circuit.

5. The method as claimed in claim 1, wherein the second heat exchanger is acted upon by hot gas heated by the combustion exhaust gas of the furnace and guided in a second closed circuit.

6. The method as claimed in claim 2, wherein the step of uncoupling and the step of reheating are controlled in a freely programmable manner.

7. The method as claimed in claim 1, wherein the combustion exhaust gases, together with the vapor part stream depleted and then thermally repurified, after acting upon at least one hot-gas circuit are led as exhaust air out of a chimney into the atmosphere.

8. The method as claimed in claim 1, wherein the stream of vapor circulated in the drying circuit is heated in the first heat exchanger from a temperature of 120–130° C. to a temperature of 300–350° C.

9. The method as claimed in claim 1, wherein a dwell time of the fibers in the tubular stream drier is 2–10 seconds.

10. The method as claimed in claim 1, wherein propulsive vapor is fed in in an order of magnitude of 30–50% of the mass flow in said feeding step.

11. The method as claimed in claim 1, wherein the fibers are dried to within 2–4% of absolute dryness.

12. The method as claimed in claim 1, wherein the dried fibers separated out of the drying circuit in said separating step are glue-coated in a following glue-coating station.

13. The method as claimed in claim 12, wherein the dried fibers are fed into a largely closed glue-coating air circuit, run through a glue-wetting zone and, in a separator following the latter, are separated from transport air carrier in the circuit.

14. The method as claimed in claim 13, wherein the transport speed of the fibers passing through the glue-wetting zone is between 20 and 35 m/s.

15. The method as claimed in claim 13, wherein the temperature of the transport air is 40–60° C.

16. The method as claimed in claim 13, wherein infiltrated air is extracted from the glue-coating air circuit via an air exit lock and is fed as additional combustion air into the combustion chamber of the furnace.

17. The method as claimed in claim 5, wherein the step of uncoupling and the step of reheating are controlled in a freely programmable manner.

18. The method of claim 14, wherein said transport speed is 27 m/s.

19. The method of claim 1, wherein the fibrous substance is wood fiber.

* * * * *